US011596247B2

(12) United States Patent
Park

(10) Patent No.: US 11,596,247 B2
(45) Date of Patent: Mar. 7, 2023

(54) PILLOW FOR HEALTHY ERGONOMIC POSITIONING OF THE NECK AND SPINE

(71) Applicant: James Park, New York, NY (US)

(72) Inventor: James Park, New York, NY (US)

( * ) Notice: Subject to any disclaimer, the term of this patent is extended or adjusted under 35 U.S.C. 154(b) by 102 days.

(21) Appl. No.: 16/885,921

(22) Filed: May 28, 2020

(65) Prior Publication Data

US 2020/0375382 A1 Dec. 3, 2020

Related U.S. Application Data

(60) Provisional application No. 62/854,159, filed on May 29, 2019.

(51) Int. Cl.
*A47G 9/10* (2006.01)

(52) U.S. Cl.
CPC .... *A47G 9/1081* (2013.01); *A47G 2009/1018* (2013.01)

(58) Field of Classification Search
CPC ..... A47G 9/1081; A47G 9/109
USPC ..... D6/601
See application file for complete search history.

(56) References Cited

U.S. PATENT DOCUMENTS

| | | | | |
|---|---|---|---|---|
| D261,681 | S | 11/1981 | Chandler | |
| 7,516,504 | B2 | 4/2009 | Guez | |
| D611,285 | S | 3/2010 | Berland et al. | |
| D615,794 | S | 5/2010 | Jorgensen et al. | |
| D618,947 | S | 7/2010 | Kalatsky | |
| D634,960 | S | 3/2011 | Anson | |
| D645,693 | S | 9/2011 | Rothbard | |
| 8,161,588 | B1 * | 4/2012 | Anson | A47G 9/109 5/636 |
| 8,566,985 | B2 | 10/2013 | Kim | |
| 8,677,531 | B2 | 3/2014 | Popitz | |
| 8,973,190 | B2 | 3/2015 | Oh et al. | |
| 9,370,269 | B2 | 6/2016 | Edwards et al. | |
| D778,086 | S | 2/2017 | O'Meara et al. | |
| 9,763,521 | B2 | 9/2017 | Krishtul | |
| D828,054 | S | 9/2018 | Chen et al. | |
| D829,470 | S | 10/2018 | Huang | |
| 10,111,526 | B2 | 10/2018 | Davis et al. | |
| D839,026 | S | 1/2019 | Huang | |
| D847,357 | S | 4/2019 | Goncharov et al. | |
| D856,028 | S | 8/2019 | Zou | |

(Continued)

FOREIGN PATENT DOCUMENTS

| | | | |
|---|---|---|---|
| CN | 105942778 | A | 9/2016 |
| EP | 0778017 | A2 | 6/1997 |

*Primary Examiner* — Eric J Kurilla
(74) *Attorney, Agent, or Firm* — Carter, DeLuca & Farrell, LLP; Francesco Sardone, Esq.

(57) ABSTRACT

A pillow includes a head support, a neck support, and an opening extending entirely through a central portion of the pillow. The head support includes a top surface and a bottom surface, and defines a first height extending between the top and bottom surfaces. The neck support is coupled to the head support and includes a top surface and a bottom surface. The top surface has a central portion and side portions. The central portion defines a second height extending between a base of the central portion and the bottom surface, and each of the side portions defines a third height extending between an apex of the respective side surface and the bottom surface. The third height is greater than the first and second heights.

15 Claims, 7 Drawing Sheets

(56) References Cited

U.S. PATENT DOCUMENTS

| | | | | | |
|---|---|---|---|---|---|
| D867,021 | S | | 11/2019 | Yang | |
| 10,561,561 | B2 | | 2/2020 | Kim | |
| D878,105 | S | | 3/2020 | Marinkovic | |
| D898,429 | S | * | 10/2020 | Huang | D6/601 |
| D904,075 | S | * | 12/2020 | Krishtul | D6/601 |
| 2002/0050007 | A1 | | 5/2002 | Kim | |
| 2006/0064819 | A1 | | 3/2006 | Mollett | |
| 2015/0047646 | A1 | * | 2/2015 | Marinkovic | A61H 1/008 128/845 |
| 2015/0265075 | A1 | | 9/2015 | Liu et al. | |
| 2016/0302589 | A1 | | 10/2016 | Peterson et al. | |
| 2019/0069698 | A1 | | 3/2019 | Lin | |
| 2020/0268183 | A1 | * | 8/2020 | Murphy | A47G 9/109 |

* cited by examiner

PILLOW FOR HEALTHY ERGONOMIC POSITIONING OF THE NECK AND SPINE

CROSS-REFERENCE TO RELATED APPLICATIONS

This application claims the benefit of and priority to U.S. Provisional Patent Application No. 62/854,159, filed May 29, 2019, the entire contents of which are incorporated herein by reference.

TECHNICAL FIELD

The present technology is generally related to a body support, and more particularly, to a pillow that provides proper alignment of the neck and spine while laying down or sleeping. The present technology also encourages sleeping flat on a user's back to decrease wrinkles caused by compression on the skin due to gravity.

BACKGROUND

Pillows typically raise the head of a user from off a bed at an incline when the user is laying in a back sleeping position. If the head is inclined from the bed, pressure is placed on the neck as the neck is pushed into a head forward position. It may also induce kyphosis by curving the neck to compensate. Additionally, pillows typically have a consistent height and do not address spinal alignment when a user is laying in a side sleeping position and/or accommodate use in either the back or side sleeping positions as the height of a pillow for the side sleeping position is different than the height of a pillow for the back sleeping position to account for correct sleeping posture for a healthy back and neck.

SUMMARY

The pillow of the present disclosure allows the neck and spine to be in a healthy ergonomic position when a user is in a back sleeping position or a side sleeping position.

In aspects, the present disclosure provides a pillow including a head support, a neck support, and an opening extending entirely through a central portion of the pillow. The head support includes a top surface and a bottom surface, and defines a first height extending between the top and bottom surfaces. The neck support is coupled to the head support and includes a top surface and a bottom surface. The top surface has a central portion and side portions. The central portion defines a second height extending between a base of the central portion and the bottom surface, and each of the side portions defines a third height extending between an apex of the respective side surface and the bottom surface. The third height is greater than the first and second heights.

The first height may be greater than the second height.

The opening may be defined through the head and neck supports, or the opening may be defined through only the head support.

The head support may include outer side surfaces and a front side surface interconnecting the top and bottom surfaces. The front surface may have a curved shape.

The neck support may include outer side surfaces and a rear side surface interconnecting the top and bottom surfaces. The rear side surface may taper outwardly and downwardly from the central portion of the neck support toward the outer side surfaces. The rear side surface may include a bump out in the central portion of the neck support.

The opening may be defined by an inner wall of the pillow. The inner wall may include a central portion having a substantially uniform diameter, and top and bottom portions having variable diameters.

The central portion of the neck support may have a variable height that increases from the second height of the base laterally towards the side portions.

Each of the side portions of the neck support may have a sloped portion and a rounded portion. The sloped portion may increase in height from the head support to the rounded portion and the rounded portion may increase in height from the sloped portion to the apex and decrease in height from the apex towards a rear side surface of the neck support.

The head portion may have a width and the neck portion may have a width, and the width of the head portion may be greater than the width of the neck portion.

In some aspects, the pillow of the present disclosure has a fully cutout central portion for where the head of a user rests when in a back sleeping position (i.e., there is no pillow material directly under the head) which allows the head to rest directly on a sleeping surface while the neck is supported in a neck support of the pillow. This allows the head and neck to be in a healthy ergonomic position that is similar to when the user is standing, which is unlike conventional pillows in which the head height or the amount of material under the head is consistent with the height or the amount of material in the other portions of the pillow or even higher in the middle of the pillow. In certain aspects, the pillow includes a rear side surface that allows clearance of the shoulder line so that the head can reach the cutout.

In some aspects, the pillow of the present disclosure has side portions that are higher than a central portion to raise the head and neck of a user when in a side sleeping position due to shoulder height raising the base of the neck higher than when lying on the back of the user. The central portion is lower than the side portions to accommodate the lower head and neck position when a user is in a back sleeping position. This configuration allows the head and neck to be in a healthy ergonomic position in either back or side sleeping positions. In certain aspects, the pillow also includes a rear side surface that tapers downwardly towards the user's body to accommodate the head when a user curls into a fetal position in a side sleeping position.

In an aspect, the opening has a non-circular profile.

According to yet another aspect of the present disclosure, a pillow is provided and includes a head support including a top surface and a bottom surface, and defining a first height extending between the top and bottom surfaces, wherein the head support defines a substantially rectangular perimetrical profile; a neck support coupled to the head support and including a top surface and a bottom surface, the top surface having a central portion and side portions, the central portion defining a second height extending between a base of the central portion and the bottom surface, and each of the side portions defining a third height extending between an apex of the respective side surface and the bottom surface, the third height being greater than the first and second heights; and an opening extending entirety through a central portion of the pillow, wherein a side surface of the head support, opposite the neck support has a convex profile.

The opening may be defined at least through the head support.

The opening may be defined by an inner wall having a non-planar surface contour.

Each of the side portions of the neck support may have a sloped portion and a rounded portion, the sloped portion increasing in height from the head support to the rounded portion and the rounded portion increasing in height from the sloped portion to the apex and decreasing in height from the apex towards a rear side surface of the neck support.

The details of one or more aspects of the present disclosure are set forth in the accompanying drawings and the description below. Other aspects, features, and advantages will be apparent from the description and drawings, and from the claims.

DETAILED DESCRIPTION

Figure 1:
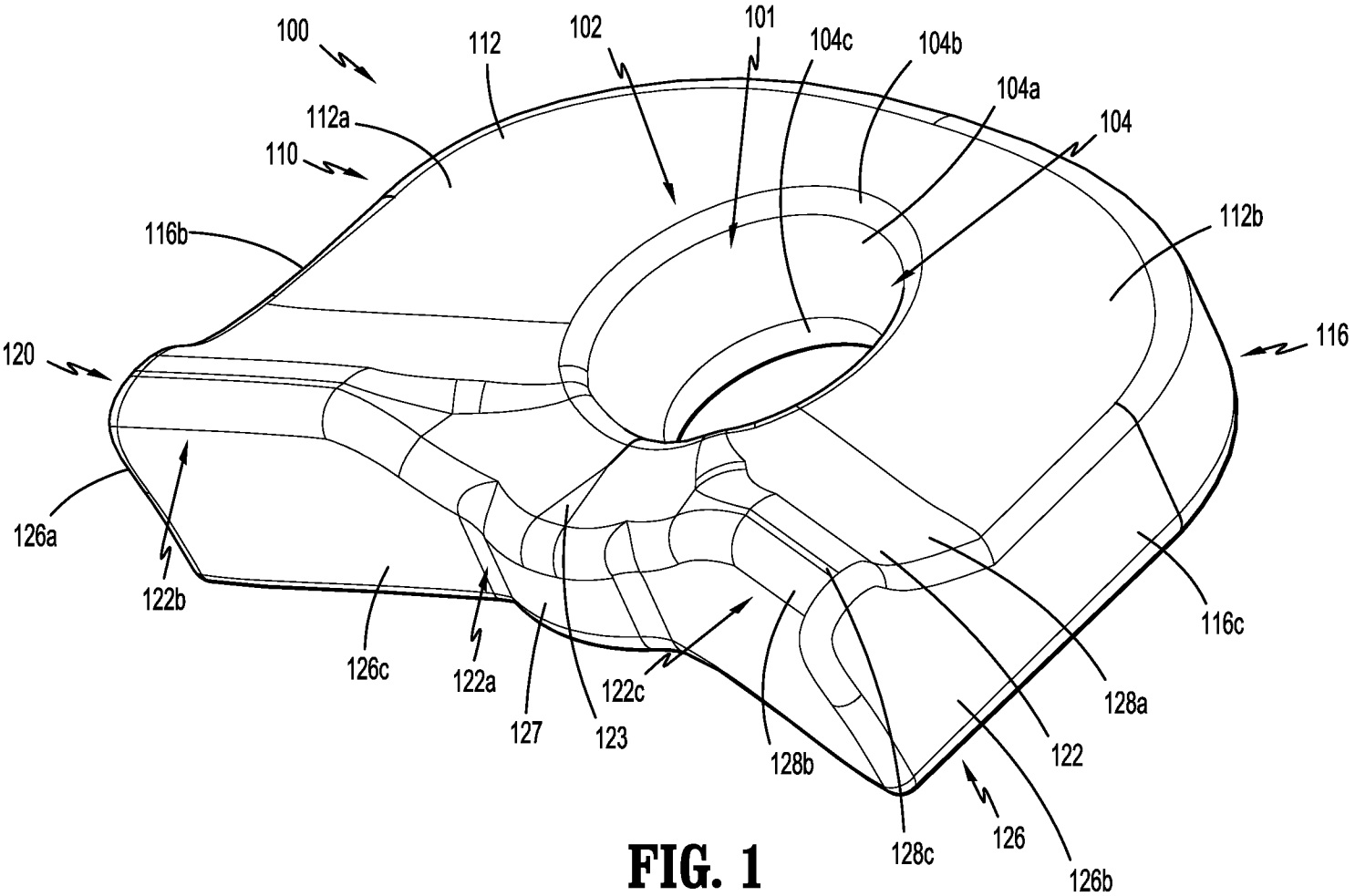
FIG. 1 is a perspective view of a pillow in accordance with an aspect of the present disclosure.

Embodiments of the present disclosure will now be described in detail with reference to the drawing figures wherein like reference numerals identify similar or identical elements. Throughout this description, the term "user" refers to the person using the device. The terms "generally," "substantially," and "about" shall be understood as words of approximation that take into account relatively little to no variation in the modified terms (e.g., differing by less than 10%). Directional reference terms, such as "downwardly," "upwardly," and the like, are used to ease description of the embodiments and are not intended to have any limiting effect on the ultimate orientation of a structure or any part thereof. In the following description, well-known functions or constructions are not described in detail to avoid obscuring the present disclosure in unnecessary detail.

Referring now to FIGS. 1-7, a pillow 100 in accordance with an aspect of the disclosure is shown. The pillow 100 includes a head support or base 110 and a neck support or base 120. The pillow 100 may have a substantially rectangular perimetrical outer profile. The head support 110 has a top surface 112, a bottom surface 114, and side surfaces 116 extending around the head support 110 and interconnecting the top and bottom surfaces 112, 114. The side surfaces 116 include a front side surface 116*a* that faces away from a user "U" (see e.g., FIG. 8A) of the pillow 100, and outer side surfaces 116*b*, 116*c* that extend laterally of the user "U". The head support 110 may also include a rear side surface (not shown) coupled/joined to or abutting against a front side surface (not shown) of the neck support 120 such that the pillow 100 has a two-part construction, or the head and neck supports 110, 120 may be integrally formed.

The neck support 120 includes a top surface 122, a bottom surface 124, and side surfaces 126 extending around the neck support 120 and interconnecting the top and bottom surfaces 122, 124. The side surfaces 126 include outer side surfaces 126*a*, 126*b* extending laterally of the user "U", and a rear side surface 126*c* that faces the shoulders of the user "U", and optionally, a front side surface as described above.

The top surfaces 112, 122 of the head and neck supports 110, 120 form a portion of the pillow 100 on which a user "U" rests his or her head and neck, respectively, and the bottom surfaces 114, 124 of the head and neck supports 110, 120 form a portion of the pillow 100 that is placed against a sleeping surface, such as a mattress. The outer side surfaces 116*b*, 116*c* of the head support 110 and the outer side surfaces 126*a*, 126*b* of the neck support 120, together, define substantially planar side surfaces of the pillow 100.

An opening or cutout 101 is defined through a central portion 102 of the pillow 100 with a majority of the opening 101 defined through the head support 110 and a minority of the opening 101 defined through the neck support 120. Specifically, the opening 101 extends entirely through the pillow 100 and is defined by at least one inner wall 104 interconnecting the top surfaces 112, 122 and the bottom surfaces 114, 124 of the head and neck supports 110, 120. It is envisioned that the opening 101 may extend entirely through only the head support 110 of the pillow 100.

The inner wall 104 of the pillow 100 includes central portion 104*a* defining a consistent or uniform diameter of the opening 101, and top and bottom portions 104*b*, 104*c* defining a static or variable diameter of the opening 101. While the opening 101 is illustrated as being circular, it is contemplated, and within the scope of the present disclosure, that the opening 101 may have a non-circular profile, including and not limited to ovular, ovoid, elliptical, triangular, rectangular, or the like. The top portion 104*b* of the inner wall 104 tapers downwardly from the top surfaces 112, 122 of the head and neck supports 110, 120 to the central portion 104*a* of the inner wall 104, and the bottom portion 104*c* of the inner wall 104 tapers upwardly from the bottom surfaces 114, 124 of the head and neck supports 110, 120 to the central portion 104*a* of the inner wall 104. Alternatively, the top portion 104*b* of the inner wall 104 could taper downwardly toward a middle thereof, in a pinch-like manner, with a single connected line from a single stitch, from the top surfaces 112, 122 of the head and neck supports 110, 120 to the central portion 104*a* of the inner wall 104. The top portion 104*b* of the inner wall 104 provides a cradle for supporting the head "H" of a user "U" (FIG. 8A), and the bottom portion 104*c* of the inner wall 104 provides space for compression of the pillow 100 and movement of the head "H" through the opening 101. Alternatively, the opening 101 may be sized to be larger than the head "H" of the user "U" so that the head "H" does not contact the inner wall 104. Additionally, the inner wall 104 may be orthogonal to the top surface 112 of the head support 110 (e.g., have a uniform diameter throughout), or may taper inwardly from the top surface 112 of the head support 110.

The opening 101 is sized and shaped to accommodate a head "H" of a user "U" when the user "U" is in a back sleeping position. In the back sleeping position, the user's head "H" is supported or disposed within the opening 101 of the pillow 100 with the back of the user's head "H" resting against the sleeping surface upon which the pillow 100 is placed, as shown and described in further detail with regard to FIGS. 8A and 8B. Thus, the size and shape of the opening 101 allows the head "H" of the user "U" to touch the sleeping surface. In aspects, the opening 101 has a diameter "D" of about 4 inches to about 10 inches, and in some aspects, the diameter "D" is about 5 inches to about 7 inches. It should be understood that the size of the opening 101 may be chosen to accommodate different sized heads (e.g., the size of the opening may conform to a small, medium, and large sizing scale). It should be further understood that while the opening 101 is shown as being substantially circular, the opening 101 may have other shapes, such as oval, triangular, rectangular, trapezoidal, and the like.

The top surface 112 of the head support 110 includes side portions 112*a*, 112*b* extending around (e.g., above and lateral to) the opening 101 of the pillow 100. The side portions 112*a*, 112*b* are sized and shaped to accommodate a head "H" of a user "U" when the user "U" is in a side sleeping position. In a side sleeping position, a side of the user's head "H" is supported against one of the side portions 112*a*, 112*b*, as shown and described in further detail with regard to FIGS. 9A-10B. While the top surface 112 is shown as being substantially planar, it should be understood that the contour of the top surface 112 may vary (e.g., be non-planar), depending, for example, on the fill type and/or fill density of the head support 110. In aspects, the thickness or height "H1" of the head support 110 is about 3 inches to about 8 inches, and in some aspects, the height "H1" is about 4 inches to about 7 inches. It should be understood that the height "H1" of the head support 110 may vary based on, for example, the fill material and compression.

The front side surface 116*a* of the head support 110 is curved or filleted and tapers downwardly towards the outer side surfaces 116*b*, 116*c* of the head support 110 (e.g., bell-shaped). The curved shape of the front side surface 116*a* allows the pillow 100 to be placed within a standard pillow case or protector (e.g., a conventional rectangular pillow case) while providing room or slack for movement of the pillow case into the opening 101 of the pillow 100 when used in the back sleeping position. The curvature of the front side surface 116*a* is selected such that any hammocking effect created by a pillow case extending across the opening 101 is eliminated, and the head "H" of the user "U" may continue to fully enter the opening 101 and continue to rest against or in contact with the sleeping surface, as intended with the present disclosure. It is envisioned that the front side surface 116*a* may have other shapes, such as linear, to give the pillow a substantially rectangular shape, and a suitable pillow case or protector sized to fit the pillow without interfering with the function of the pillow may be utilized therewith.

Figure 2:
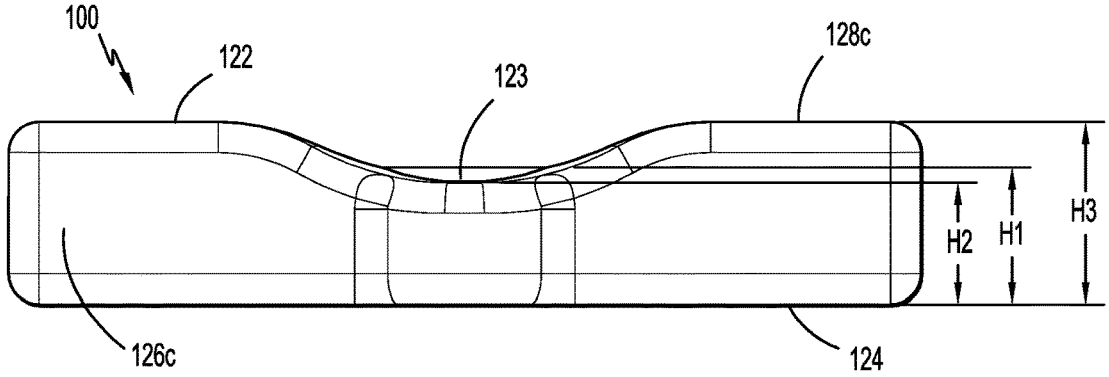
FIG. 2 is a rear elevation view of the pillow of FIG. 1.
Figure 3:
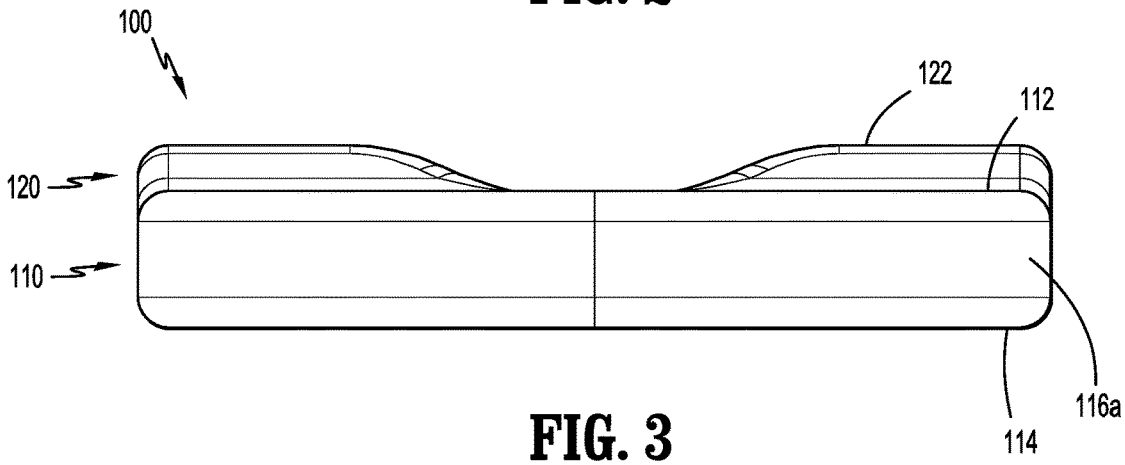
FIG. 3 is a front elevation view of the pillow of FIG. 1.
Figure 4:
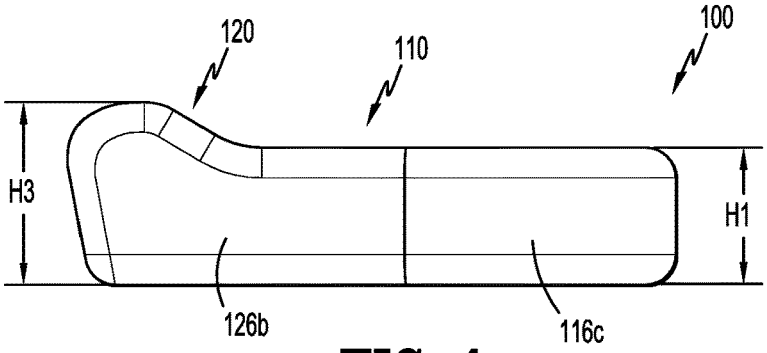
FIG. 4 is a left side elevation view of the pillow of FIG. 1.
Figure 5:
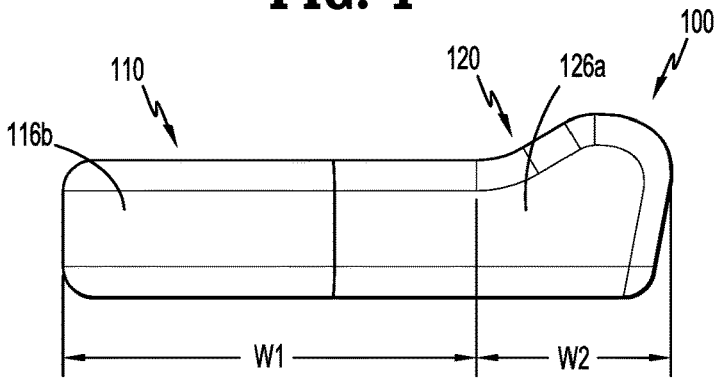
FIG. 5 is a right side elevation view of the pillow of FIG. 1.
Figure 6:
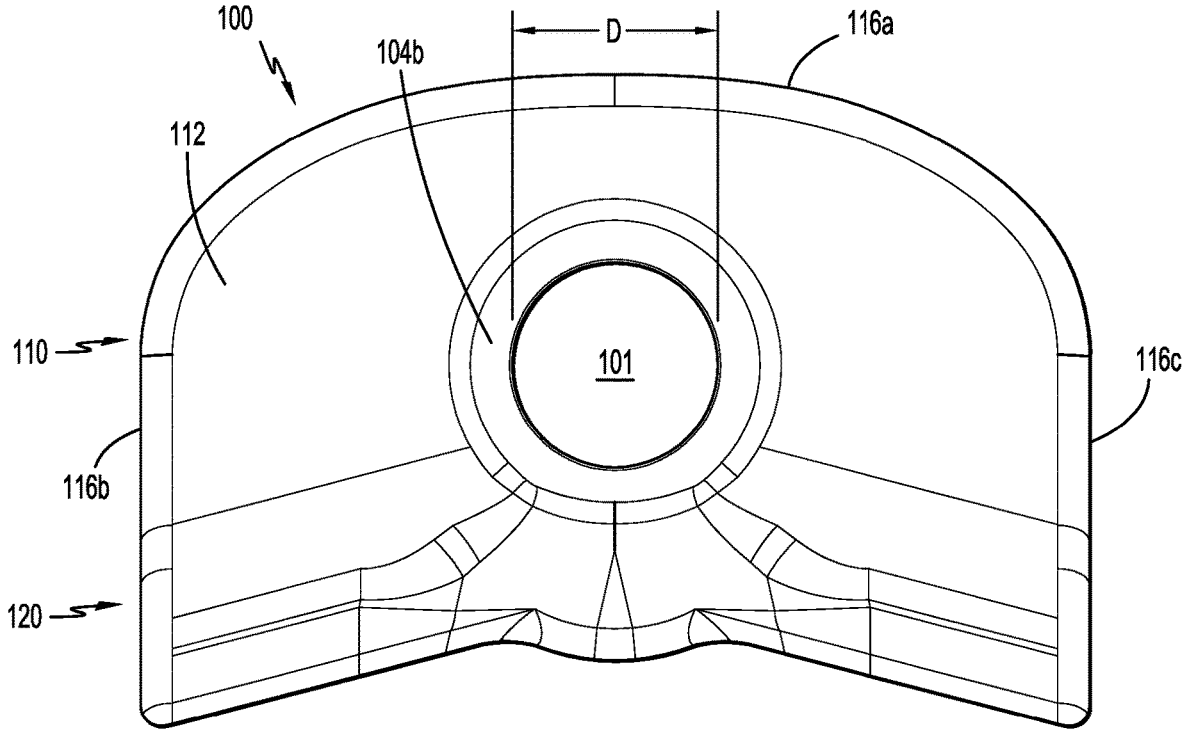
FIG. 6 is a top plan view of the pillow of FIG. 1.
Figure 7:
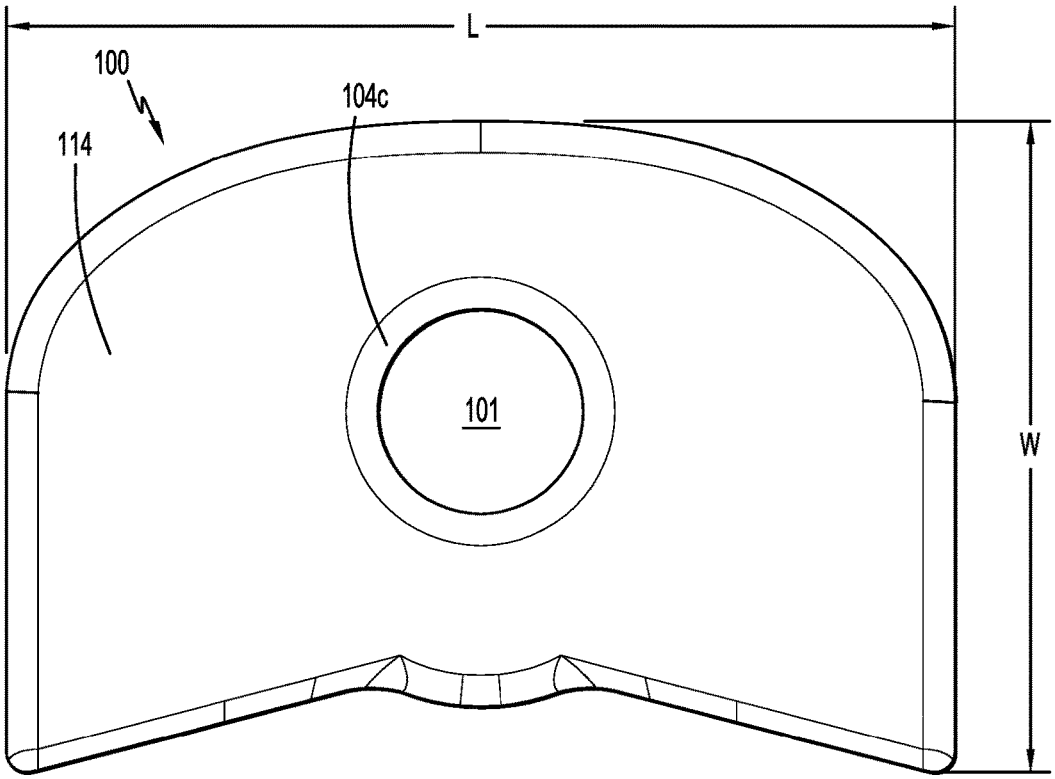
FIG. 7 is a bottom plan view of the pillow of FIG. 1.

The top surface 122 of the neck support 120 includes a central portion 122*a* extending from the opening 101 of the pillow 100 to the rear side surface 126*c* of the neck support 120, and flaring outwardly towards side portions 122*b*, 122*c* of the neck support 120. The central portion 122*a* has a substantially U-shaped profile, as seen in FIG. 2, having a variable height that increases along a slope or curve extending from a base 123 of the central portion 122*a* laterally towards the side portions 122*b*, 122*c*. The base 123 of the central portion 122*a* is longitudinally aligned with a center of the opening 101 of the pillow 100 and has a height "H2" that is less than the height "H1" of the head support 110. In aspects, the height "H2" of the base 123 of the neck support 120 is about 50% to about 100% of the height H1" of the head support, and in some aspects, the height "H2" is about 75% to about 95% of the height "H1," and in certain aspects, the height "H2" is about 88% of the height "H1." In aspects, the height "H2" of the base 123 of the neck support 120 is about 1 inch to about 5 inches, and in some aspects, the height "H2" is about 2 inches to about 4 inches.

The side portions 122*b*, 122*c* are mirror images of each other and include a first or sloped portion 128*a* and a second or rounded portion 128*b*. The first portion 128*a* extends between the head support 110 and the second portion 128*b*, and the second portion 128*a* extends from the first portion 128*a* to the rear side surface 126*c* of the neck support 120. The side portions 122*b*, 122*c* each have a variable height that increases along the first portion 128*a* and culminates at an apex 128*c* of the second portion 128*b*. Specifically, the first portion 128*a* has a slope or a curve increasing in height from the top surface 112 of the head support 110 to the second portion 128*b*, and the second portion 128*b* has a rounded shape increasing in height from the first portion 128*a* to the apex 128*c* and then decreasing in height from the apex 128*c* towards the rear side surface 126*c*. The shape of the first and/or second portions 128*a*, 128*b* may vary so long as the side portions 122*b*, 122*c* are configured to support the neck of a user "U" in a side sleeping position, as described in further detail below.

The apex 128*c* is the thickest part of the pillow 100. In aspects, the height "H3" of the apex 128*c* is about 1.1 times to about 1.8 times as much as the height "H2" of the base 123 of the central portion 122*a*, and in some aspects, the height "H3" is about 1.5 times as much as the height "H2." In aspects, the height "H3" of the apex 128*c* is about 1.3 times to about 1.5 times as much as the height "H1" of the head support 110, and in some aspects, the height "H3" is about 1.4 times as much as the height "H1." In aspects, the height "H3" of the apex 128*c* is about 4 inches to about 10 inches, and in some aspects, the height "H3" is about 5 inches to about 9 inches.

Figure 8A:
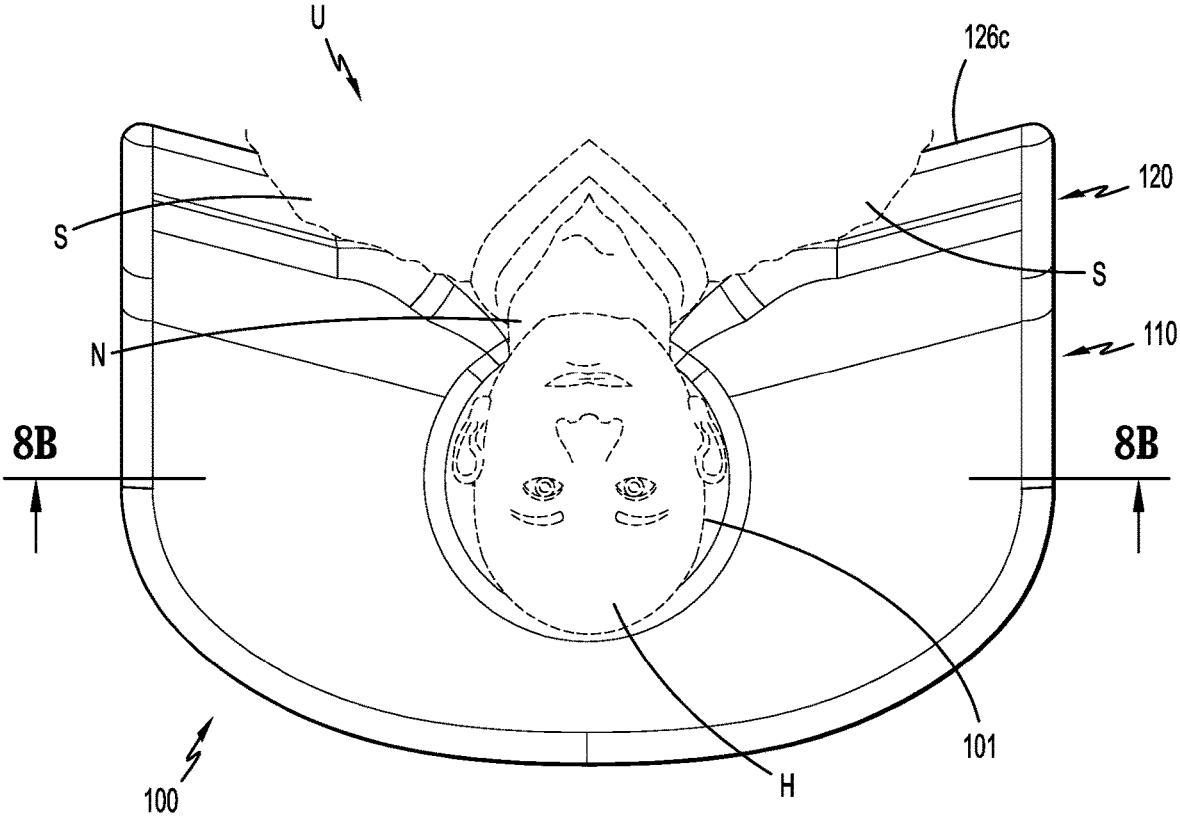
FIG. 8A is a top plan view of the pillow of FIG. 1, shown with a user, in phantom, lying on the pillow in a back sleeping position.
Figure 8B:
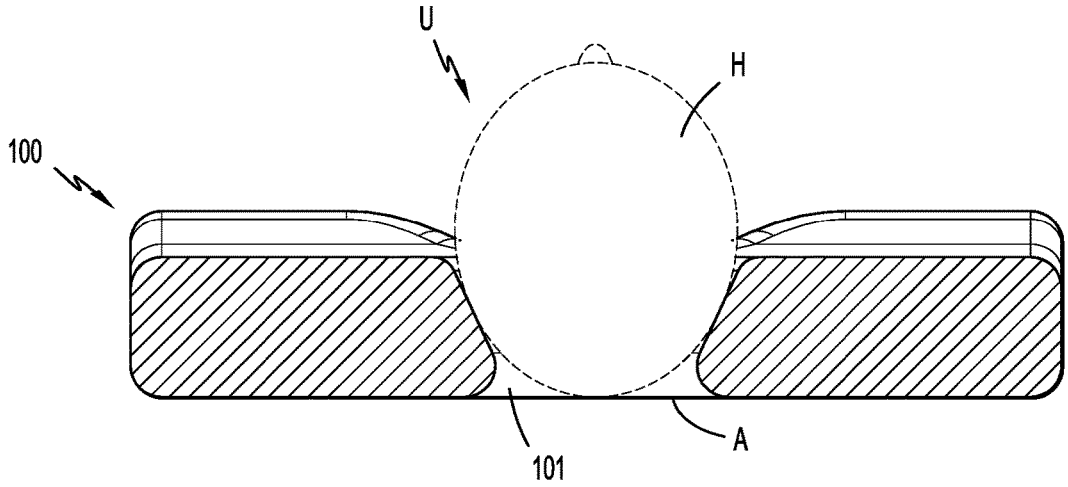
FIG. 8B is a cross-sectional view of the pillow of FIG. 8A, taken along section line 8B-8B of FIG. 8A.

The central portion 122*a* supports the neck of a user "U" in the back sleeping position, as shown and described in further detail with regard to FIGS. 8A and 8B, and the side portions 122*b*, 122*c* supports the neck of the user "U" in a side sleeping position, as shown and described in further detail with regard to FIGS. 9A-10B. The rear side surface 126*c* of the neck support 120 has a generally M-shaped profile in which the central portion 122*a* includes a bump out 127 for additional cervical support and the side portions 122*b*, 122*c* taper outwardly and downwardly towards the outer side surfaces 126*a*, 126*b*, respectively, of the neck support 120 for clearance of and/or contour with the shoulders of the user "U". While the rear side surface 126*c* about the side portions 122*b*, 122*c* are shown as tapering linearly outwardly and away from the central portion 122*a*, it should be understood that side portions 122*b*, 122*c* may be curved (see e.g., FIG. 11) to conform to the shape of the shoulders of a user. It should be further understood that the rear side surface 126*c* may have a generally U-shaped or C-shaped profile should the central portion 122*a* be formed without the bump out 127.

The pillow 100 can be made in various sizes. For example, the pillow 100 may have an overall size comparable to that of a conventional pillow (e.g., king, queen, or standard pillows). As another example, the pillow 100 may be sized based on a height that ranges from a child to an oversized adult. In aspects, the pillow 100 has a length "L" that is about 18 inches to about 36 inches, and in some aspects, the length "L" is about 20 inches to about 36 inches. In aspects the pillow 100 has a width "W" that is about 12 inches to about 21 inches, and in some aspects, the width "W" is about 13 inches to about 19 inches. The width "W1" of the head support 110 is greater than the width "W2" of the neck support 120. In aspects, the ratio of width "W1" of the head support 110 to width "W2" of the neck support 120 is up to about 4:1, and in some aspects, the ratio of the width "W1" to the width "W2" is about 3:1.

The size and/or shape of the various parts of the pillow 100 may also vary to accommodate, for example, different head sizes (e.g., variations in the size of the opening of the pillow), neck lengths (e.g., variations in the width of the neck support and/or the distance from the neck support to the opening), user height (e.g., variations in the height of the head and neck supports), etc.

The pillow 100 can be made from several fill materials and coverings. The fill material may be a poly fill, down, feathers, latex, foam, memory foam, memory foam pieces, microbeads, or combinations thereof, among other materials within the purview of those skilled in the art to give the pillow 100, or parts thereof, the desired characteristics, such as firmness, loft, or support. The neck support 120 may have a variable density to accommodate proper spinal alignment while allowing a softer area for the head "H" of the user "U" for comfort. The material forming the covering may be chosen to have a desired softness, durability, or other characteristics within the purview of those skilled in the art.

In one aspect, a covering of the head support 110 and the neck support 120 may have a unitary construction and define a single cavity therein that is filled with one or more fill materials. In some aspects, a single fill material is provided throughout the entirety of the pillow 100, and in some other aspects, the head and neck supports 110, 120 are filled with different fill materials. The heights in the various parts of the pillow 100, as described above, may be adjusted by the fill material chosen, the fill density, and/or the cut of the covering (e.g., variable volume spaces within the covering can control or influence the height). In another aspect, the pillow 100 may be molded, for example, from a foam or memory foam. A mold in the shape of the pillow may be injected with material to attain the shape and density requirements for each part of the pillow. In yet another aspect, the pillow 100 may have a two pillow construction, for example a pillow inside a pillow, where the inside pillow can be of variable density through the neck support as compared to the rest of pillow.

Turning now to FIGS. 8A and 8B, in a method of use, a user "U" may lie on the pillow 100 in a supine or back sleeping position. In the back sleeping position, the user "U" places his or her head "H" within the opening 101 of the pillow 100 and aligns the pillow 100 such that his or her neck "N" is supported within the central portion 122*a* (FIG. 1) of the neck support 120 and his or her shoulders "S" are adjacent to the rear side edge 126*c* of the neck support 120. The rear side edge of the neck support 120 provides clearance for the shoulders "S" so that the shoulders "S" are positioned against the sleeping surface "A" on which the pillow 100 is placed and the head "H" can reach the opening 101 of the pillow 100. The sides of the head "H" are supported on the head support 110 and the back of the head "H" is positioned against and supported on the sleeping surface "A." It should be understood, for example, depending on the diameter of the opening 101 through the pillow 100, the sides of the head "H" may not necessarily be supported on the head support 110 to provide, for example, space for movement of the head "H". The height "H2" (FIG. 2) of the central portion 122*a* of the neck support 120 supports the neck "N" while the head "H" and shoulders "S" are resting on the sleeping surface "A" to keep the neck angle in a straight position and the head neutral to maintain proper alignment.

Figure 9A:
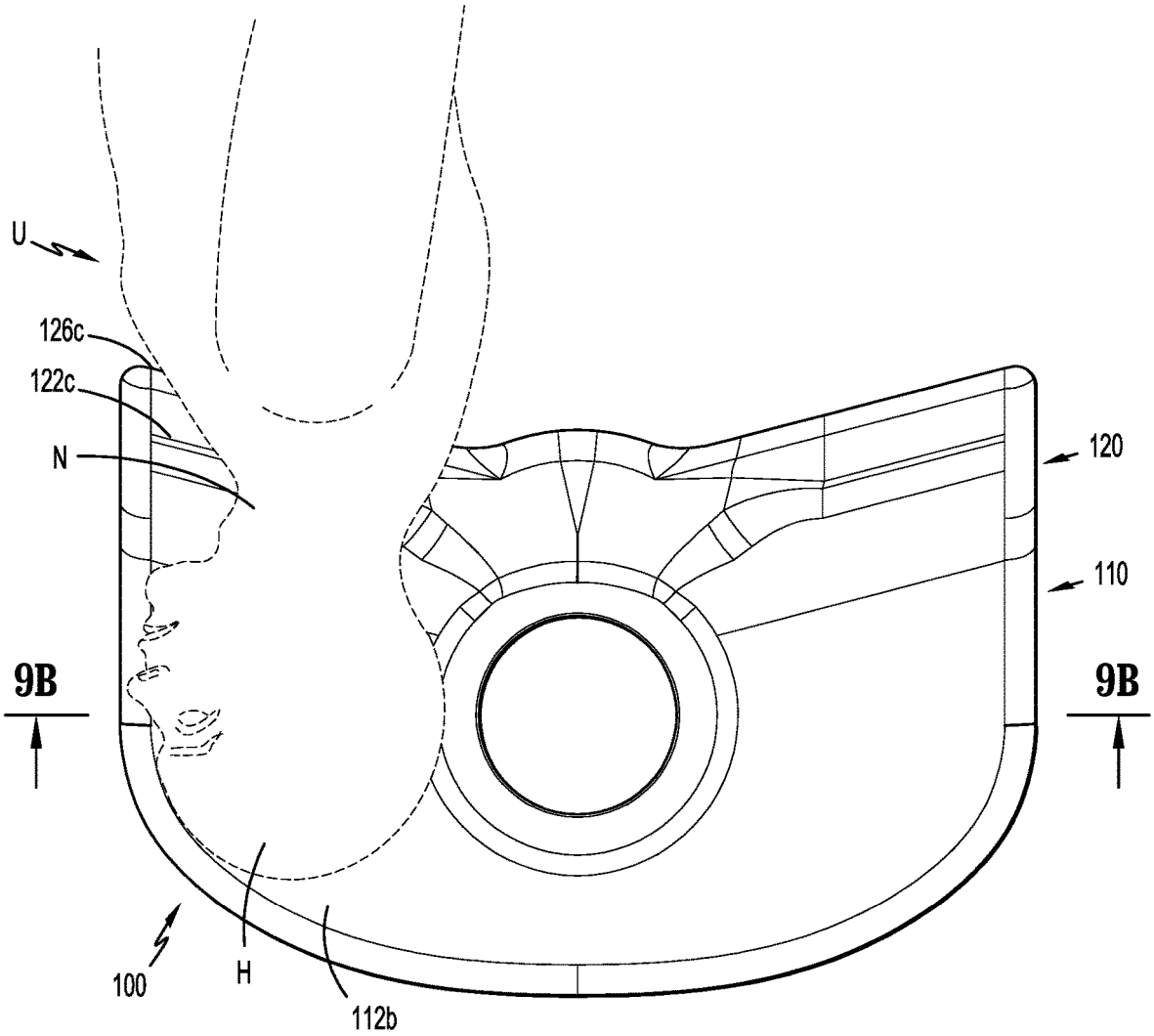
FIG. 9A is a top plan view of the pillow of FIG. 1, shown with a user, in phantom, lying on the pillow in a side sleeping position.
Figure 9B:
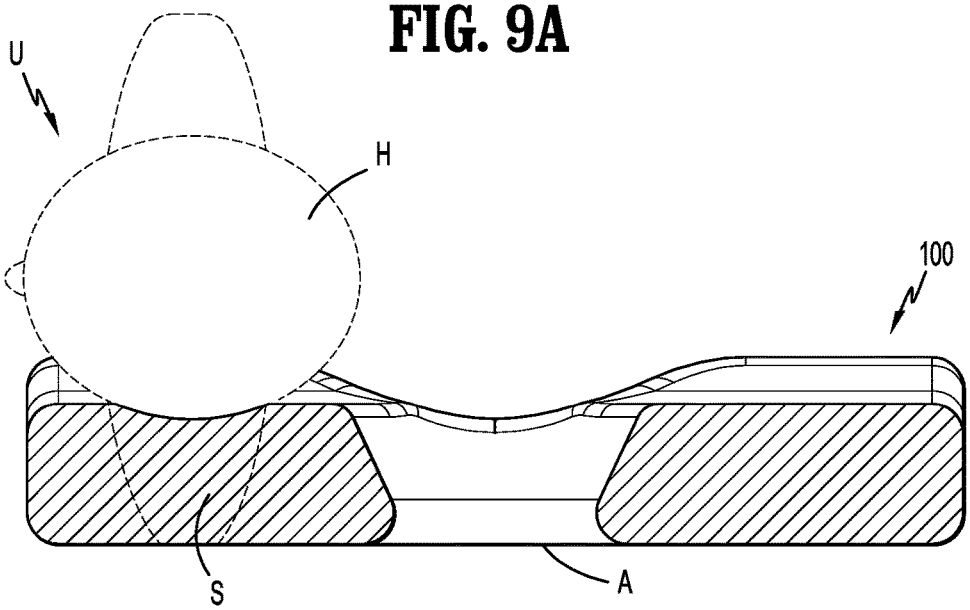
FIG. 9B is a cross-section view of the pillow of FIG. 9A, taken along section line 9B-9B of FIG. 9A.
Figure 10A:
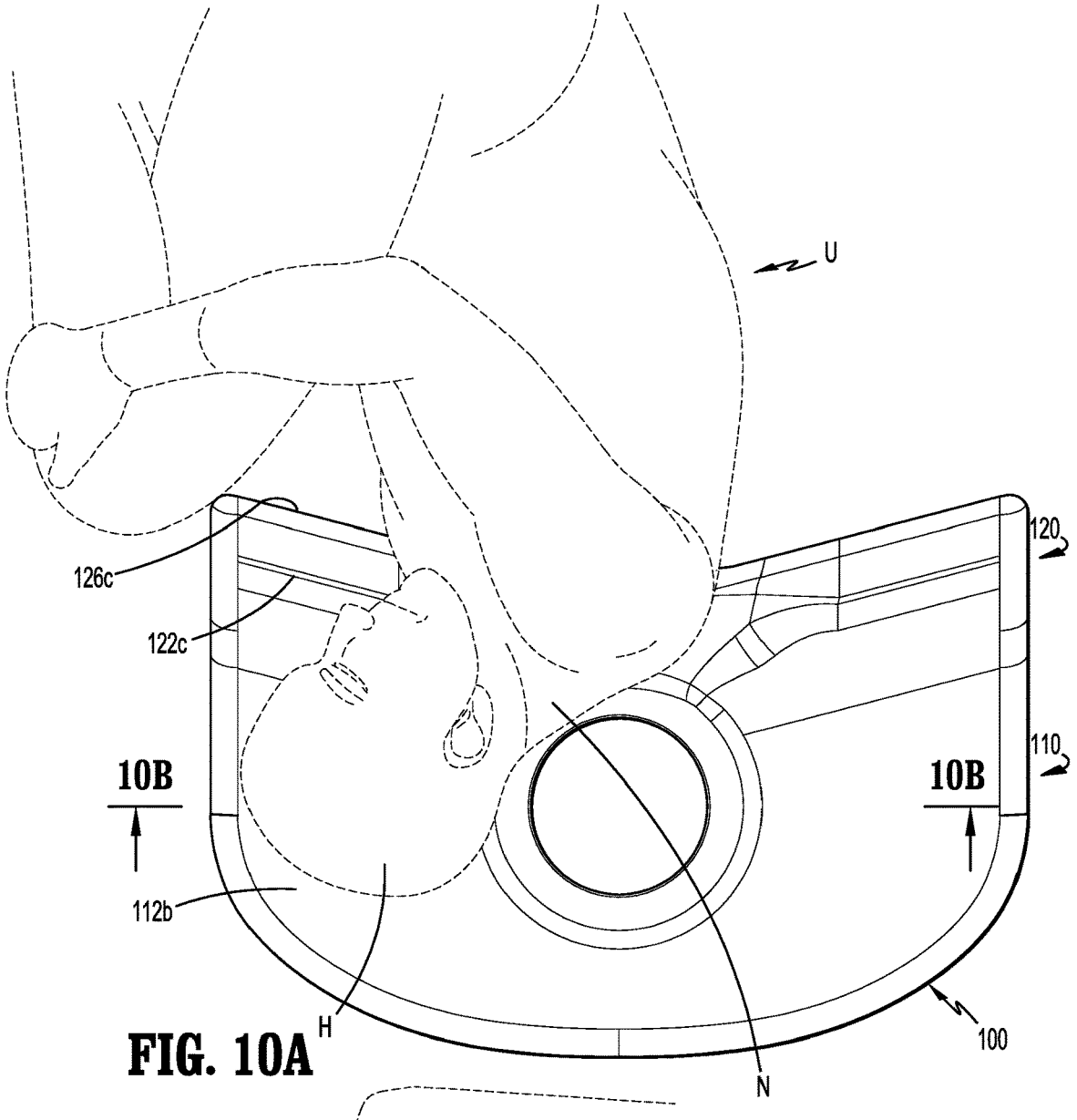
FIG. 10A is a top plan view of the pillow of FIG. 1, shown with a user, in phantom, lying on the pillow in a side sleeping position.
Figure 10B:
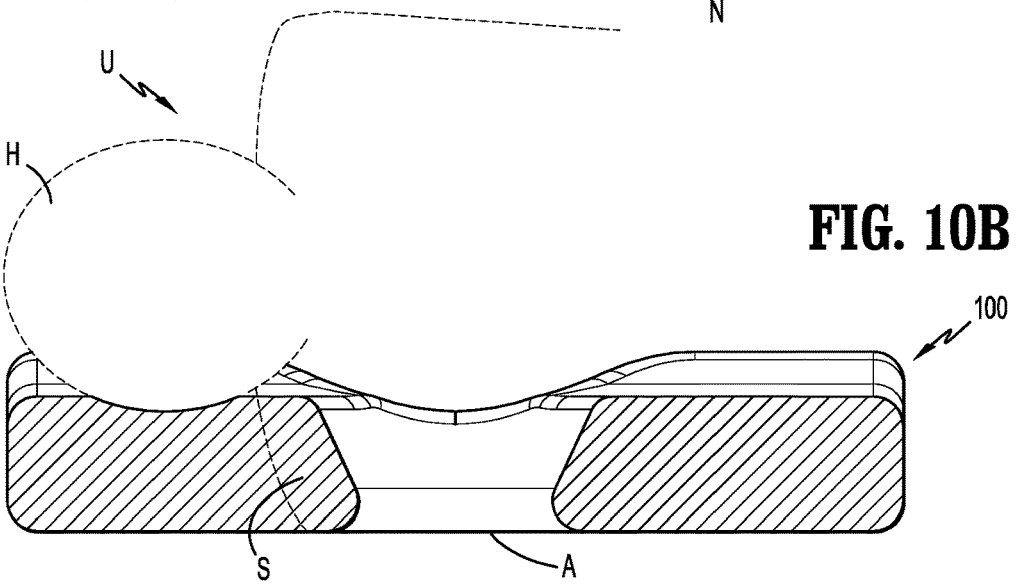
FIG. 10B is a cross-sectional view of the pillow of FIG. 10A, taken along section line 10B-10B of FIG. 10A.

As shown in FIGS. 9A-10B, in other methods of use in accordance with aspects of the present disclosure, a user "U" may lie on the pillow 100 in a lateral or side sleeping position. While shown in a left lateral recumbent position, the user "U" may also be in a right lateral recumbent position which would be a mirror image of those shown in FIGS. 9A-10B as the pillow 100 is symmetrical. As seen in FIGS. 9A and 9B, the user "U" is in a substantially straight body position while as shown in FIGS. 10A and 10B the user "U" is in a fetal body position. It should be further understood that other lateral sleeping positions (e.g., a semi-fetal position) are equally applicable to the pillow 100 of the present disclosure.

In the side sleeping position, the user "U" places a side of his or her head "H" against the side portion 112*b* of the head support 110 and aligns the pillow 100 such that his or her neck "N" is supported on the side portion 122*c* of the neck support 120 and the user's shoulders "S" are adjacent to the rear side edge 126*c*. The side portion 112*b* of the head support 110 lifts the head "H" higher than the sleeping surface "A" to accommodate proper alignment with the position and height of the shoulders "S," and the side portion 122*c* of the neck support 120 supports the neck "N" in proper alignment with the head "H" and shoulders "S". As seen in FIGS. 10A and 10B, the downward taper of the rear side edge 126*c* is aligned with the angle of the head "H" when the user "U" is in the fetal position.

The construction of the pillow 100 allows a user "U" to move between the back and side sleeping positions. For example, a user "U" can roll from the back sleeping position seen in FIG. 8A to the side sleeping positions seen in FIGS. 9A and 10A. As the user "U" rolls towards one side, the head "H" lifts out of the opening 101 and against one of the side surfaces 112*a*, 112*b* of the head support 110 such that the head "H" raises above the sleeping surface "A" and the neck "N" moves from the central portion 122*a* of the neck support 120 to one of the side surfaces 122*b*, 122*c* such that the neck "N" is also raised higher to accommodate the position of the shoulders "S." The downward taper of the rear side edge 126*c* addresses the natural motion of side sleepers who move to a fetal position (FIG. 10A) as the head "H" remains fully supported all the way towards the neck "N".

The pillow 100 may also be used in a prone or stomach sleeping position as the side portions 112*a*, 112*b* of the head support 110 can be used as a conventional pillow.

Figure 11:
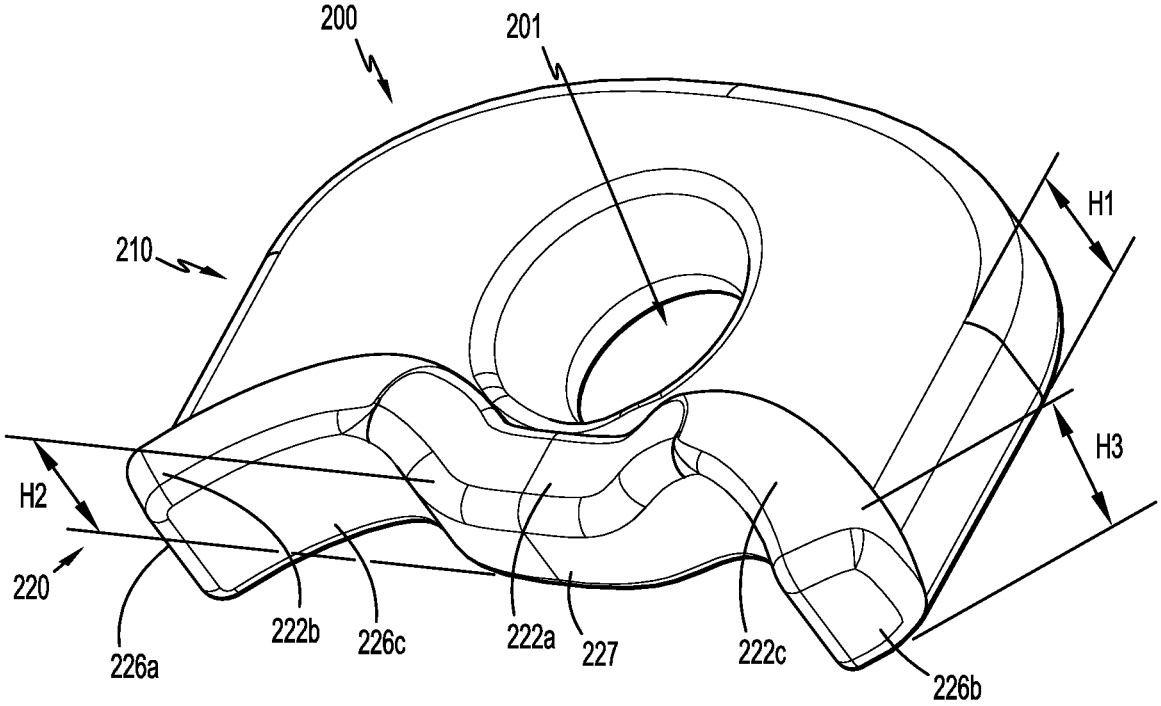
FIG. 11 is a perspective view of a pillow in accordance with another aspect of the present disclosure.
Figure 12:
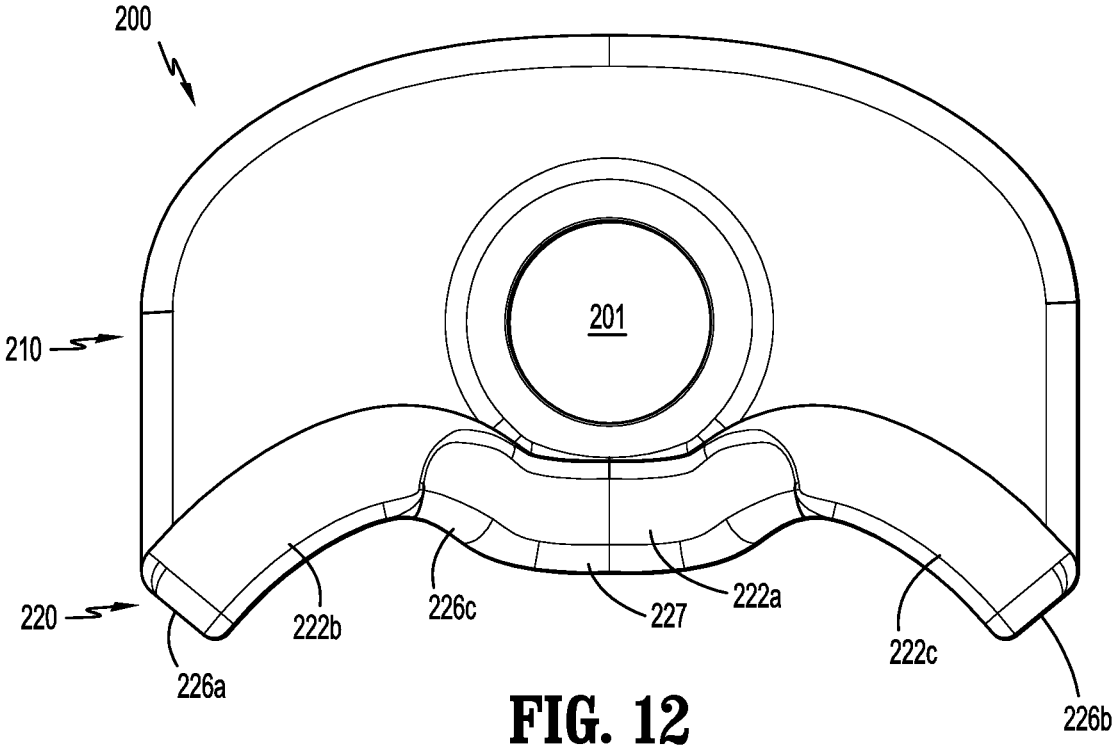
FIG. 12 is a top plan view of the pillow of FIG. 11.

As shown in FIGS. 11 and 12, a pillow 200 in accordance with another aspect of the present disclosure is shown. The pillow 200 is substantially similar to the pillow 100 and will be described with respect to the differences therebetween. Accordingly, it should be understood that various components of the disclosure, such as those numbered in the 100 series, correspond to components of the disclosure similarly numbered in the 200 series, such that redundant explanation of similar components need not be repeated herein.

The pillow 200 includes a head support or base 210 and a neck support or base 220. The pillow 200 has a two-part construction in which the head support 210 includes a fill material, such as a poly fill, and the neck support 220 is a molded foam, such as memory foam. The neck support 220 could also have a poly fill construction. In some aspects, the pillow 200 has a pillow inside a pillow construction in which the neck support 220 is a pillow placed inside a pillow having the head support 210 and a space for the neck support 220.

An opening 201 of the pillow 200 extends entirely through the head support 210. The neck support 220 includes a central portion 222*a* disposed below the opening 201 and side portions 222*b*, 222*c* disposed on opposed sides of the central portion 222*a*. The central portion 222*a* has a substantially U-shaped profile having a variable height that increases towards the side portions 222*b*, 222*c*, and the side portions have a uniform height. The height "H2" of the central portion 222*a* is less than the height "H1" of the head support 210, and the height "H3" of the side portions 222*b*, 222*c* are greater than the height "H1" of the head support 210.

The rear side surface 226*c* of the neck support 220 has a generally M-shaped profile in which the central portion 222*a* includes a bump out 227 for additional cervical support and the side portions 222*b*, 222*c* taper downwardly toward the outer side surfaces 216*a*, 266*b*, respectively, of the neck support 220 for clearance of and/or contour with the shoulders of the user "U".

It should be understood that parts of the pillow 100, 200 can vary. For example, the pillow may have an opening defined through a side of the pillow (as opposed to the central portion of the pillow) and the side portion may be on only one side of the pillow (as opposed to both). As another example, neck supports may be provided on both the front and rear of the pillow. The neck supports may have the same construction or may be of different sizes and/or density to account for different sized users and/or variability in desired stiffness/softness.

It should be understood that pillow 100, 200 of the present disclosure may be utilized in a variety of industries and/or have other applications. For example, the pillow may be used for physical therapy or in other medical treatment facilities that require patients to lie on their back or side. A chiropractor or massage therapist could use the pillow, not for sleeping, but for laying patients in correct anatomical position while laying on their back or sides for treatment on a table or bed. As another example, the pillow may be used to encourage laying in a back sleeping position to limit wrinkles in the skin during sleep caused by shoulder contraction creating wrinkles in the center chest area (décolletage or cleavage), cheek compression of the face ("sleeplines"), and/or wrinkles in the neck due to neck angle decreasing the space in the frontal neck area.

Persons skilled in the art will understand that the devices and methods specifically described herein and illustrated in the accompanying figures are non-limiting exemplary embodiments, and that the description, disclosure, and figures should be construed merely exemplary of particular embodiments. It is to be understood, therefore, that the disclosure is not limited to the precise embodiments described, and that various other changes and modifications may be effected by one skilled in the art without departing from the scope or spirit of the disclosure. Additionally, it is envisioned that the elements and features illustrated or described in connection with one exemplary embodiment may be combined with the elements and features of another exemplary embodiment without departing from the scope of the disclosure, and that such modifications and variations are also intended to be included within the scope of the disclosure. Accordingly, the subject matter of the disclosure is not to be limited by what has been particularly shown and described.

What is claimed is:

1. A pillow comprising:

a head support including a top surface and a bottom surface, and defining a first height extending between the top and bottom surfaces;

a neck support coupled to the head support and including a top surface and a bottom surface, the top surface having a central portion and first and second side portions, the central portion defining a second height extending between a base of the central portion and the bottom surface, and each of the first and second side portions defining a third height extending between an apex of the first or second side portion and the bottom surface, the third height being greater than the first and second heights; and an opening extending entirety through a central portion of the pillow, the opening configured and dimensioned to accommodate a head of a user, the head supportable within the opening and extendable through the opening from the top surface of the head support to the bottom surface of the head support, whereby the head of the user comes into contact with a surface on which the pillow rests.

2. The pillow according to claim 1, wherein the first height is greater than the second height.

3. The pillow according to claim 1, wherein the opening is defined through the head and neck supports, and wherein the opening defines a diameter which is greater than the first height of the head support.

4. The pillow according to claim 1, wherein the opening is defined through only the head support.

5. The pillow according to claim 1, wherein the head support includes outer side surfaces and a front side surface interconnecting the top and bottom surfaces.

6. The pillow according to claim 5, wherein the front side surface has a curved shape.

7. The pillow according to claim 1, wherein the neck support includes outer side surfaces and a rear side surface interconnecting the top and bottom surfaces.

8. The pillow according to claim 7, wherein the rear side surface curves outwardly and downwardly from the central portion of the neck support toward the outer side surfaces.

9. The pillow according to claim 8, wherein the rear side surface includes a bump out in the central portion of the neck support.

10. The pillow according to claim 1, wherein the opening is defined by an inner wall of the pillow.

11. The pillow according to claim 10, wherein the inner wall includes a central portion having a substantially uniform diameter, and top and bottom portions having variable diameters.

12. The pillow according to claim 1, wherein the central portion of the neck support has a variable height that increases from the second height of the base laterally towards the first and second side portions.

13. The pillow according to claim 1, wherein each of the first and second side portions of the neck support has a sloped portion and a rounded portion, the sloped portion increasing in height from the head support to the rounded portion and the rounded portion increasing in height from the sloped portion to the apex and decreasing in height from the apex towards a rear side surface of the neck support.

14. The pillow according to claim 1, wherein the head support has a width and the neck support has a width, the width of the head support being greater than the width of the neck support.

15. The pillow according to claim 1, wherein the top and bottom surfaces of the head support are substantially planar throughout the head support.

* * * * *